US011684844B1

(12) United States Patent
Elphick

(10) Patent No.: US 11,684,844 B1
(45) Date of Patent: Jun. 27, 2023

(54) SPHERICAL PUZZLE AND ASSOCIATED METHOD(S)

(71) Applicant: Kenneth Elphick, Jacksonville, FL (US)

(72) Inventor: Kenneth Elphick, Jacksonville, FL (US)

( * ) Notice: Subject to any disclaimer, the term of this patent is extended or adjusted under 35 U.S.C. 154(b) by 0 days.

(21) Appl. No.: 17/650,356

(22) Filed: Feb. 8, 2022

Related U.S. Application Data

(60) Provisional application No. 63/146,756, filed on Feb. 8, 2021.

(51) Int. Cl.
*A63F 9/08* (2006.01)

(52) U.S. Cl.
CPC ..... *A63F 9/0857* (2013.01); *A63F 9/0838* (2013.01); *A63F 9/0861* (2013.01)

(58) Field of Classification Search
CPC ..... A63F 9/0857; A63F 9/0838; A63F 9/0861
See application file for complete search history.

(56) References Cited

U.S. PATENT DOCUMENTS 4,441,715 A * 4/1984 Titus ..... A63F 9/0834 273/153 S
4,856,786 A * 8/1989 Gyovai ..... A63F 9/0873 273/153 S
4,865,323 A * 9/1989 Heusinkveld ..... A63F 9/0857 273/153 S
8,109,515 B2 * 2/2012 Fedoseyev ..... A63F 9/0861 273/156
2005/0269770 A1 * 12/2005 Mak ..... A63F 9/0838 273/153 R
2009/0230621 A1 * 9/2009 Wittevrongel ..... A63F 9/0842 273/153 S
2010/0301558 A1 * 12/2010 Speegle ..... A63F 9/12 273/153 S
2011/0272882 A1 * 11/2011 Yahyavi ..... A63F 9/0861 273/153 S
2014/0232064 A1 * 8/2014 Marin ..... A63F 9/0861 273/153 S

FOREIGN PATENT DOCUMENTS

WO WO-2018020329 A1 * 2/2018

* cited by examiner

*Primary Examiner* — Steven B Wong
(74) *Attorney, Agent, or Firm* — Ashkan Najafi

(57) ABSTRACT

A spherical puzzle includes a portable body having a central core, a plurality of co-extensively shaped sections rotatably disposed about the central core, a plurality of locking mechanisms associated with the sections, respectively, and a plurality of hemispherical travel paths configured about the body. Advantageously, the sections are dynamically configured to freely rotate along the hemispherical travel paths to create a desired pattern. In this manner, locking mechanisms slidably engage the sections such that each section remain rotatably aligned along the hemispherical travel paths and about the central core.

17 Claims, 9 Drawing Sheets

SPHERICAL PUZZLE AND ASSOCIATED METHOD(S)

CROSS REFERENCE TO RELATED APPLICATIONS

This is a non-provisional patent application that claims priority to and benefit of U.S. provisional patent application No. 63/146,756 filed 2-8-2021, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to logic puzzles and, more particularly, to a specially configured spherical puzzle including a plurality of rotatable sections selectively configurable to a desired pattern.

Prior Art

There are many different types of spherical puzzles known in the art. The puzzles generally disclose connected pieces that can be scrambled or unscrambled by displacing some pieces relative to one another about a common point or plane. In particular, three-dimensional logical puzzles include a plurality of interconnected sections to be unscrambled by rotating some of the sections relative to each other sequentially along planes in space. The rotation of individual pieces or groups of pieces provides a great number of possible combinations of the individual pieces only one or a few of which are solutions. The solutions are desired pattern or color combinations selected by the creator or manufacturer.

Of particular interest are the puzzles including sections coupled together to form a spherical shape, and which involves the relative rotation of two complete half spheres. These disclosures are interesting both as standalone embodiments and as parts of more complex mechanisms. The complexity of these puzzles can be appreciated by looking at the number and orientation of their axes of rotation, and at the means of keeping the sections interlocked.

Accordingly, a need remains for a spherical puzzle in order to overcome at least one of the above-noted shortcomings. The exemplary embodiment(s) satisfy such a need by a specially configured spherical puzzle including a plurality of rotatable sections that is convenient and easy to use, lightweight yet durable in design, versatile in its applications, and designed to be selectively configurable to a desired pattern.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a spherical puzzle for providing user enjoyment. These and other objects, features, and advantages of the non-limiting exemplary embodiment(s) are provided by a spherical puzzle including a portable body including a central core, a plurality of co-extensively shaped sections rotatably disposed about the central core, a plurality of locking mechanisms associated with the sections, respectively, and a plurality of hemispherical travel paths configured about the body. Advantageously, such sections are dynamically configured to freely rotate along the hemispherical travel paths to create a desired pattern. Advantageously, such locking mechanisms slidably engage the sections such that the sections remain rotatably aligned along the hemispherical travel paths and about the central core. Such a structural configuration yields the new, useful, and unexpected results of ensuring the sections smoothly rotate and engage the locking mechanisms during extended use.

In a non-limiting embodiment, the body has an outer surface of a ball.

In a non-limiting embodiment, the central core has a sphere shape.

In a non-limiting embodiment, the body has a spherical shape.

In a non-limiting embodiment, each of the sections includes a plurality of slotted tracks arranged in a stacked configuration, a guide rail juxtaposed adjacent to the slotted tracks, an outer surface exposed to an ambient atmosphere, and a cut-out area located adjacent to the outer surface, an inner surface hidden from the ambient atmosphere and having a guide member statically affixed thereto. Advantageously, the guide member is rotated about the central core, and associated ones of the slotted tracks and the guide rails are slidably interfitted along alternate ones of the sections.

In a non-limiting embodiment, the slotted tracks have arcuate shapes, and the guide rail has an arcuate shape.

In a non-limiting embodiment, the locking mechanism includes a spring-actuated snap lock including a resiliently compressible frame, a ball joint attached to the resilient frame, and a pair of stops located adjacent to the outer surface, a disc mated to the ball joint. Advantageously, the spring-actuated snap lock slidably engages and disengages the stops as the section is rotated along the hemispherical travel paths and thereby maintains the section aligned about the central core.

The present disclosure further includes a method of utilizing a spherical puzzle for providing user enjoyment. Such a method includes the initial step of: providing a portable body including a central core, a plurality of co-extensively shaped sections rotatably disposed about the central core, a plurality of locking mechanisms associated with the sections, respectively, and a plurality of hemispherical travel paths configured about the body. Advantageously, the method further includes the steps of: dynamically configuring the sections to freely rotate along the hemispherical travel paths and create a desired pattern; and the locking mechanisms slidably engaging the sections such that the sections remain rotatably aligned along the hemispherical travel paths and about the central core. Such method steps yield the new, useful, and unexpected results of ensuring the sections smoothly rotate and engage the locking mechanisms during extended use.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
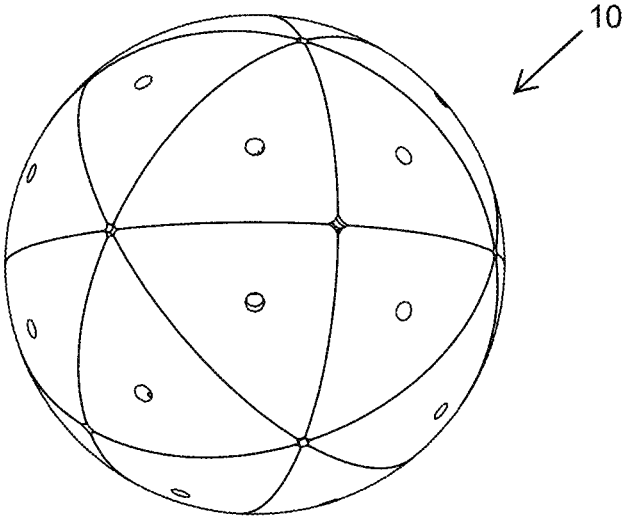
FIG. 1 is a perspective view of a spherical puzzle, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

Figure 2:
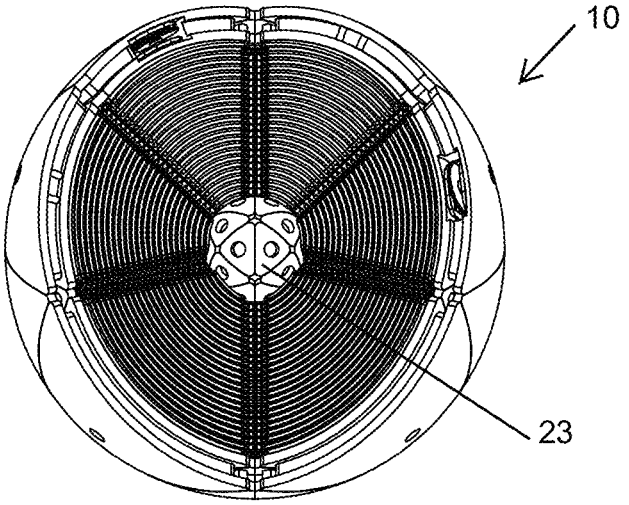
FIG. 2 is a partial cut-away view of the spherical puzzle.
Figure 3:
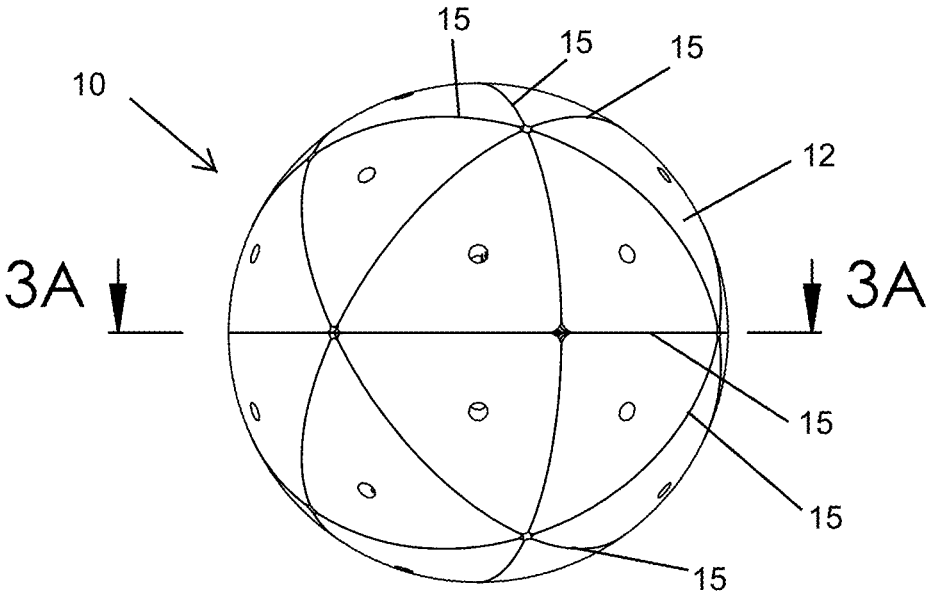
FIG. 3 is another perspective view of the spherical puzzle shown in FIG. 1.
Figure 3A:
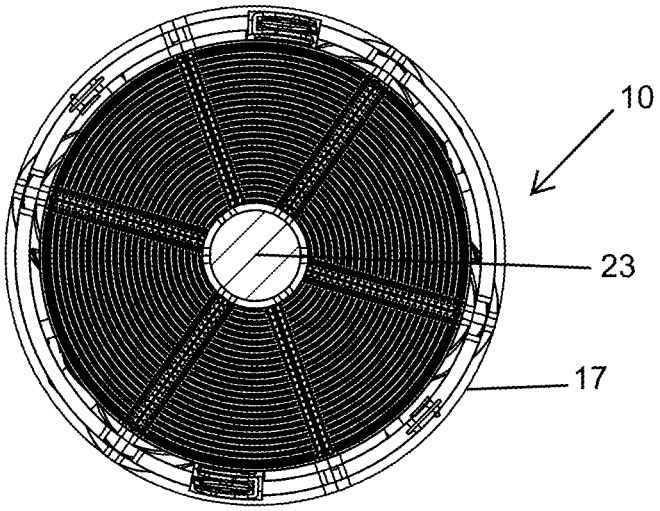
FIG. 3A is a cross-sectional view taken along line 3A-3A in FIG. 3.
Figure 4:
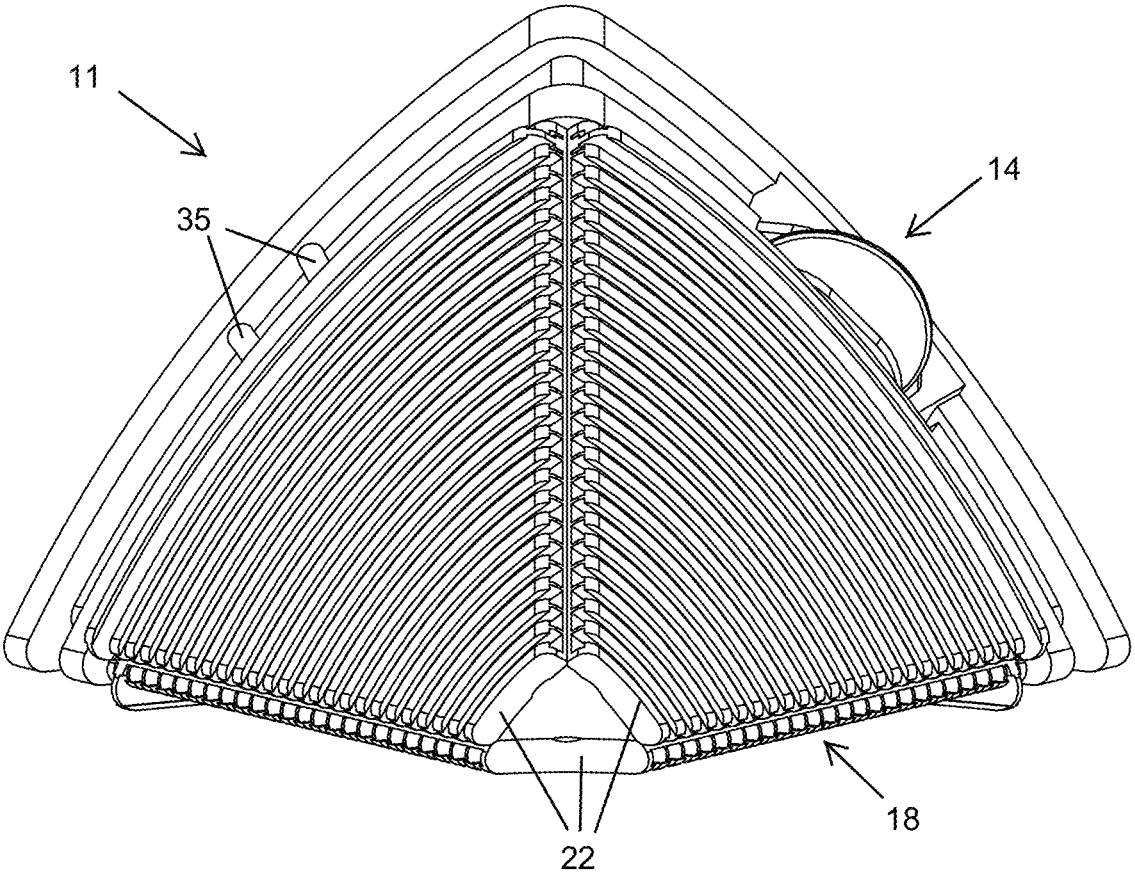
FIG. 4 is an enlarged perspective view of a non-limiting exemplary section.
Figure 5:
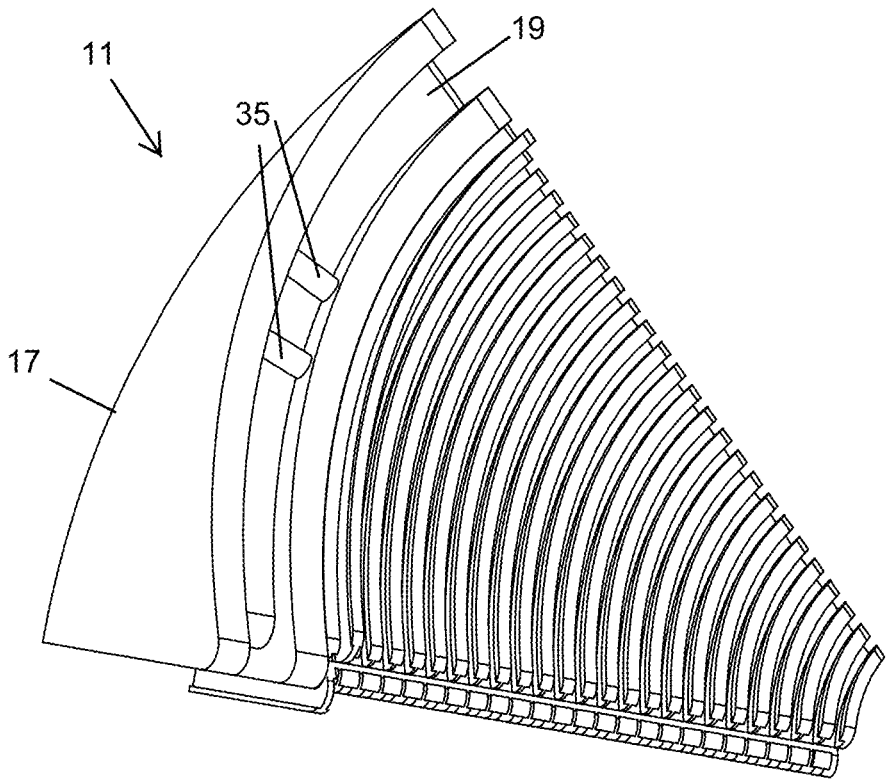
FIG. 5 is a side elevational view of the section shown in FIG. 4.
Figure 6:
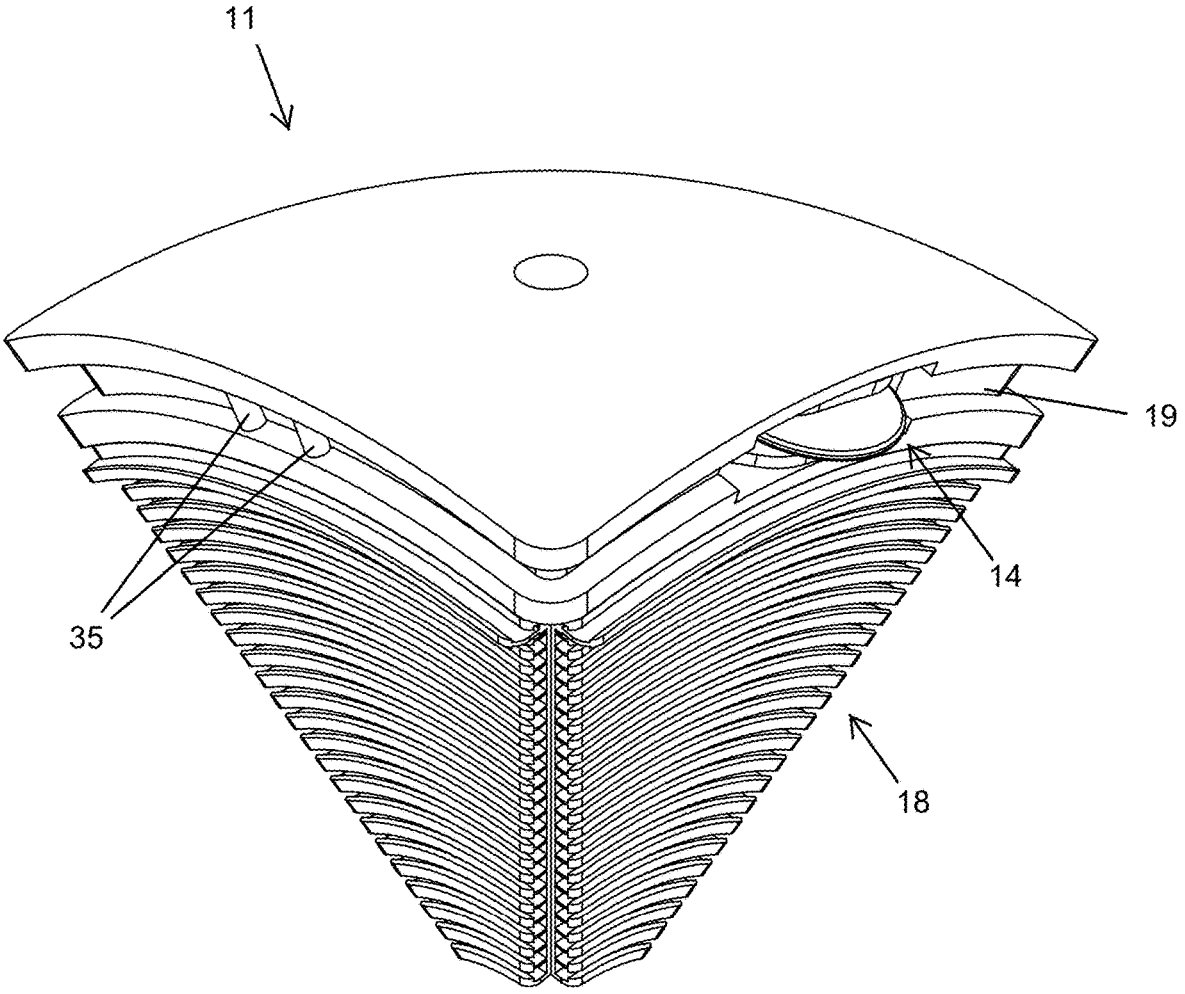
FIG. 6 is a front elevational view of the section shown in FIG. 4.
Figure 7:
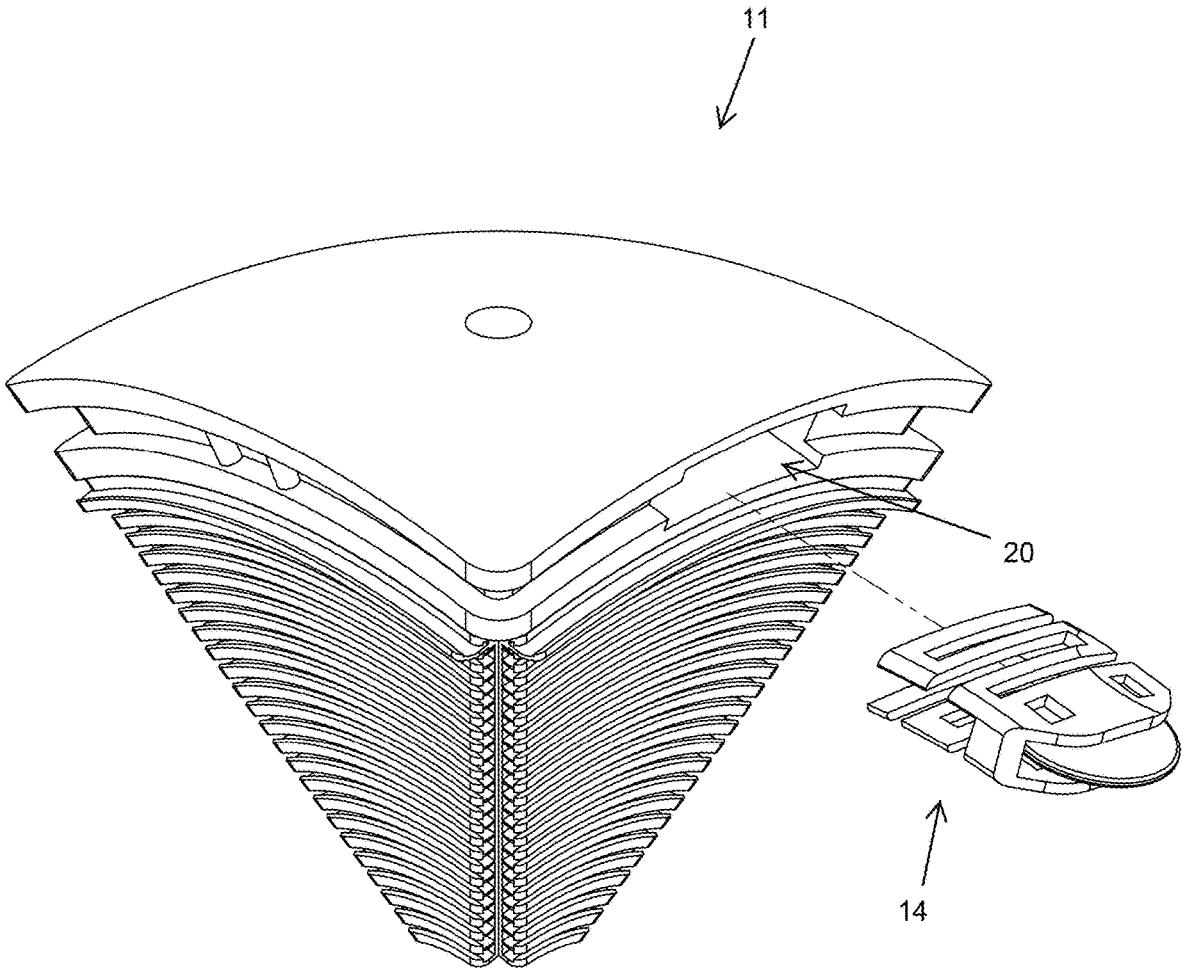
FIG. 7 is an exploded view of the section shown in FIG. 6.
Figure 8:
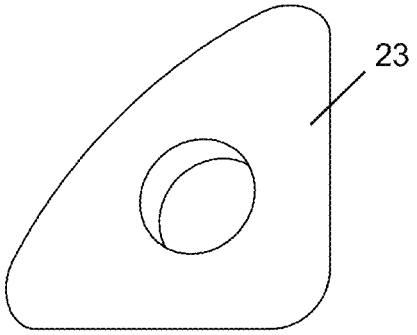
FIG. 8 is a perspective view of a guide member.
Figure 9:
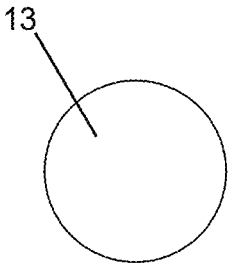
FIG. 9 is a front elevational view of a spherical central core.
Figure 10:
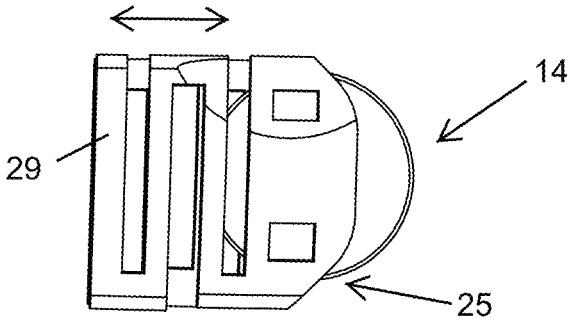
FIG. 10 is a top plan view of a locking mechanism.
Figure 11:
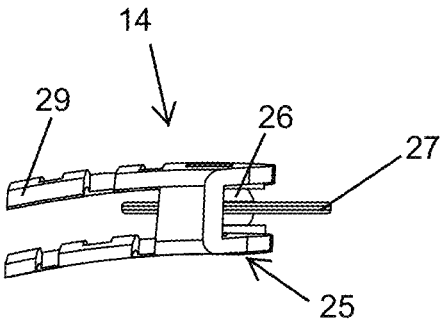
FIG. 11 is a side elevational view of the locking mechanism shown inn FIG. 10.
Figure 12:
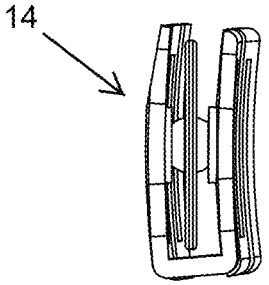
FIG. 12 is a perspective view of the locking mechanism.
Figure 13:
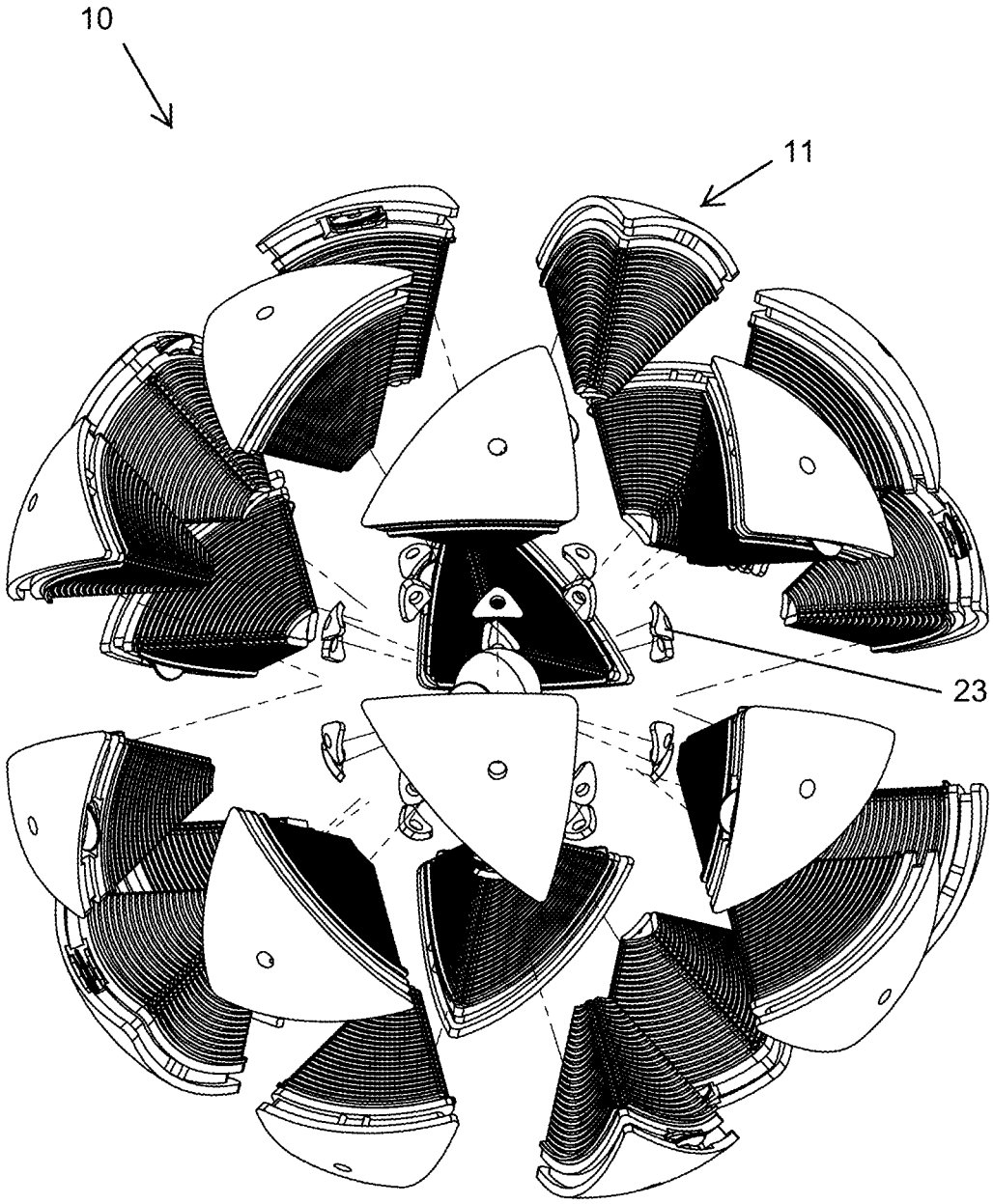
FIG. 13 is an exploded view of the spherical puzzle showing the interrelationship between the major components thereof.
Figure 14:
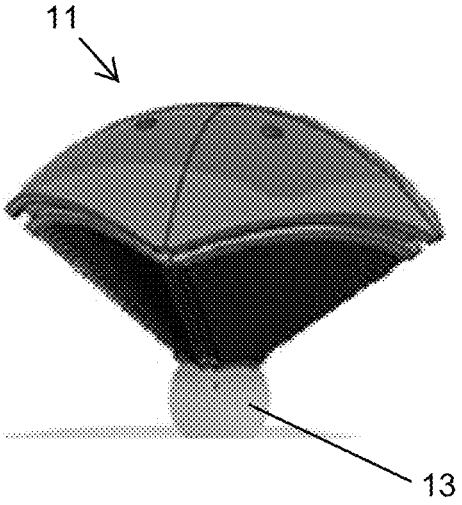
FIG. 14 is a side elevational view of one section attached to the spheric central core.
Figure 15:
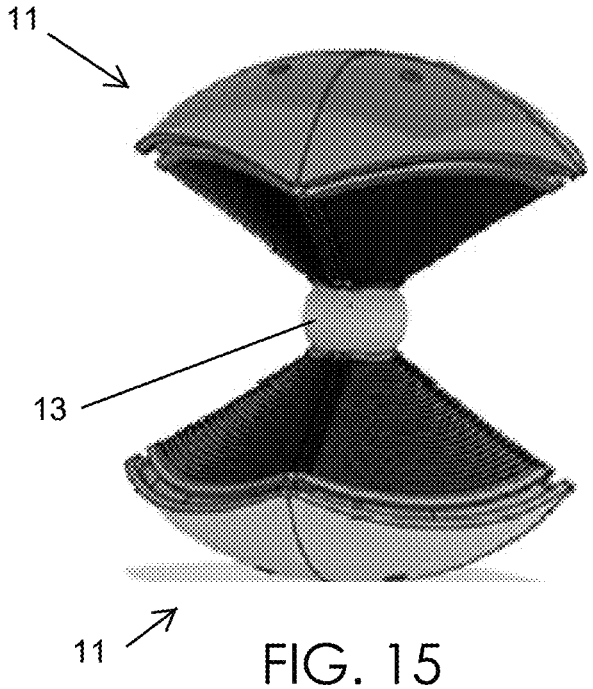
FIG. 15 is a side elevational view of two opposing sections attached to the spheric central core.
Figure 16:
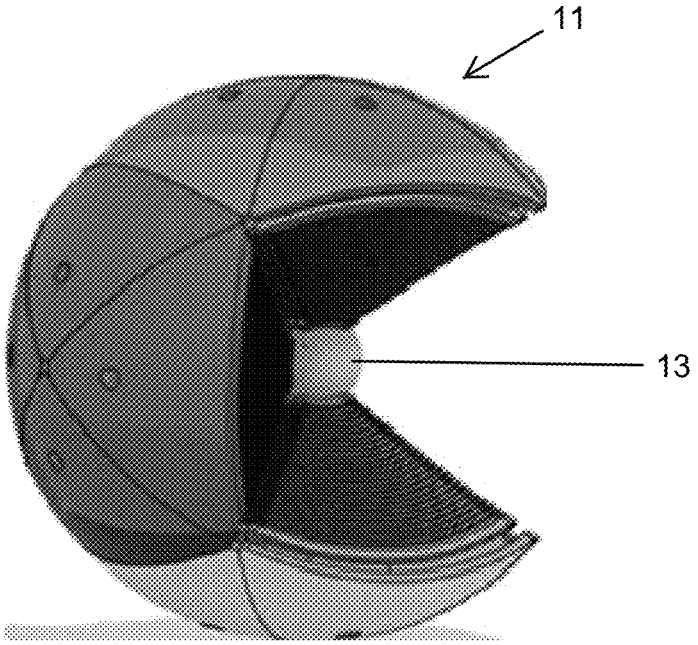
FIG. 16 is a cut-away view showing two sections removed from the spheric puzzle.

The non-limiting exemplary embodiment(s) is/are referred to generally in FIGS. 1-16 and is/are intended to provide a non-limiting exemplary embodiment(s) of the present disclosure is referred to generally in the figures and is intended to provide a specially configured spherical puzzle 10 including a plurality of rotatable sections 11 selectively configurable to a desired pattern. It should be understood that the exemplary embodiment(s) may be used to play a variety of puzzle games, and should not be limited to any particular puzzle game described herein.

Referring to FIGS. 1-16 in general, in a non-limiting exemplary embodiment(s), the spherical puzzle 10 includes a portable body 12 having a central core 13, a plurality of co-extensively shaped sections 11 rotatably disposed about the central core 13, a plurality of locking mechanisms 14 associated with the sections 11, respectively, and a plurality of hemispherical travel paths 15 configured about the body 12. Advantageously, the sections 11 are dynamically configured to freely rotate along the hemispherical travel paths 15 to create a desired pattern. In this manner, locking mechanisms 14 slidably engage the sections 11 such that each section 11 remain rotatably aligned along the hemispherical travel paths 15 and about the central core 13. Such a structural configuration yields the new, useful, and unexpected results of ensuring the sections 11 smoothly rotate each wedge-shaped section 11 along 180 degrees and any of the six planes of the sphere 10 while selectively engaging the locking mechanisms 14 as needed.

In a non-limiting exemplary embodiment, the body 12 has an outer surface 17 of a ball.

In a non-limiting exemplary embodiment, the central core 13 has a sphere shape.

In a non-limiting exemplary embodiment, the body 12 has a spherical shape.

In a non-limiting exemplary embodiment, each of the sections 11 includes a plurality of slotted tracks 18 arranged in a stacked configuration, a guide rail 19 juxtaposed adjacent to the slotted tracks 18, an outer surface 17 exposed to ambient atmosphere, a cut-out area 20 located adjacent to the outer surface 17, and an inner surface 22 hidden from the ambient atmosphere. Such an inner surface 22 has a guide member 23 statically affixed thereto. Such a guide member 23 is rotated about the central core 13. Advantageously, associated ones of the slotted tracks 18 and the guide rails 19 are slidably interfitted along alternate ones of the sections 11.

In a non-limiting exemplary embodiment, the slotted tracks 18 have arcuate shapes, and the guide rail 19 has an arcuate shape.

In a non-limiting exemplary embodiment, the locking mechanism 14 includes a spring-actuated snap lock 25 having a resiliently compressible frame 29, a ball joint 26 attached to the resilient frame, and a disc 27 mated to the ball joint 26. A pair of stops 35 are located adjacent to the outer surface 17. Advantageously, the spring-actuated snap lock 25 slidably engages and disengages the stops 35 as the section 11 is rotated along the hemispherical travel paths 15 and thereby maintains the section 11 aligned about the central core 13.

In a non-limiting exemplary embodiment, the spherical puzzle 10 of twenty-four equally shaped sections 11 forms a sphere, wherein the sections 11 are rotatably connected together to allow the sections 11 to be scrambled by rotating hemispheres 180 degrees along any of the six planes (e.g., great circles) of the assembled sphere 10. Any section 11 can be scrambled with any of the remaining twenty-three sections 11 and twenty-four combinations.

In a non-limiting exemplary embodiment, each section 11 of the spherical puzzle 10 has three sides. One of the three sides is provided with a cut-out area 20 (e.g., cut-out area). A spring-actuated snap lock 25 (e.g., unique roller disc spring) is adjustably interfitted at each cut-out area 20. Each spring-actuated snap lock 25 includes a disc 27 having a ball joint 26 that acts to secure each section 11 is temporarily locked to an adjacent section and maintains the puzzle sections 11 in alignment about a single central spherical core 13. Such a structural configuration yields the new, useful, and unexpected results of ensuring the sections 11 smoothly rotate each wedge-shaped section 11 along 180 degrees and any of the six planes of the sphere 10 while selectively engaging the locking mechanisms 14 as needed.

In a non-limiting exemplary embodiment, as noted above, the sphere-shaped puzzle 10 includes twenty-four equally shaped sections 11 that are arranged around a single central spherical core 13. The twenty-four individual sections 11 form a larger sphere body 12 that has six dividing planes (e.g., great circles, hemispherical travel paths 15) such that any two hemispheres, of the formed sphere body 12, can be rotated 180 degrees relative to one another to scramble and unscramble the twenty-four individual sections 11 relative to one another. Any of the twenty-four sections 11 can rotate, along these 180-degree hemispherical travel paths 15, to any other section 11 location. No section 11 holds a fixed or special position within the spherical arrangement of the puzzle 10.

In a non-limiting exemplary embodiment, each of the individual twenty-four sections 11, arranged to form the sphere body 12 around the central spherical core 13, has twenty-four arcuate slotted tracks 18 arranged on each of the three sides thereof. These twenty-four arcuate slotted tracks 18 are stacked along the planes of each of the three sides of each individual section.

In a non-limiting exemplary embodiment, the twenty-four stacked arcuate slotted tracks 18 on the three sides of each section 11 are the same on each section 11. Each on the twenty-four individual sections 11 has three uniquely located arcuate connecting guide rails 19. Thus, there is one arcuate connecting guide rail 19 per side of each section 11. The position of each arcuate guide rails 19 reside at one unique location of the arcuate slotted tracks 18 each of the three sides of each individual section 11. Each of the twenty-four sections 11 has three arcuate guide rails 19 located at the same position at each side of the stack of twenty-four arcuate slotted tracks 18. This arrangement allows the unique numbered arcuate guide rails 19 of any one section 11 to have a connecting access to any of the other arcuate slotted tracks 18 without colliding or interfering with any other individual section's uniquely numbered arcuate guide rails 11. Such guide rails define the paths along which the resilient snap locks 25 travel.

In a non-limiting exemplary embodiment, the twenty-four arcuate slotted tracks 18, on the three sides of each individual section 11, create the connecting slotted tracks 18 at the rails of each section 11 and can be used to connect all twenty-four sections 11 together to form the sphere-shaped puzzle 10. Each of the individual twenty-four sections 11 has a single wider U-shaped arcuate guide rail 19 aligned along each of the three sides, that is positioned and designed to allow for a spring-actuated snap lock 25 to travel along and maintained section 11 alignment. As noted above, the spring-actuated snap lock 25 includes a disc 27 attached to a spring frame 29 via a ball joint 26 located within the center of disc 27. This structural configuration allows the spring-actuated snap lock 25 to rotate past other spring-actuated snap locks 25 without unintended interference therewith.

In a non-limiting exemplary embodiment, the frame 29 that the disc 27 sits within serves as a resilient spring. Thus, the disc 27 is attached to the frame 29, which acts as a flexible spring. The frame 29 is designed to resiliently compress and decompress like a spring. The spring-actuated snap lock 25 slides into the cut-out area 20 (e.g., slot, cavity, groove, chamber, channel) at each section 11. When the disc 27 encounters a new section 11, the disc 27 sits between a pair of stops 35 for maintaining section 11 alignment relative to each other. Advantageously, such a structural configuration allows the spring-actuated snap lock 25 to compress and decompress within the cut-out area 20 and thereby acts as a spring for the attached disc 27. Each disc 27 is fitted into an associated spring frame 29 via an associated ball joint 26 that allows it to pass another disc 27 without snapping or interfering therewith, yet still snapping into place at the snap lock 25 stop locations. Notably, one-third of the sections 11 have the spring-actuated snap lock 25 positioned at a first side thereof, and one-third sections 11 have the stops 35 positioned at a second side thereof, and one-third sections 11 have neither the stops 35 nor the snap lock 25 such that no two spring-actuated snap locks 25 engage each other along the six dividing planes (e.g., hemispherical travel paths 15). Such a structural configuration yields the new, useful, and unexpected results of ensuring the sections 11 smoothly rotate each wedge-shaped section 11 along 180 degrees and any of the six planes of the sphere 10 while selectively engaging the locking mechanisms 14 as needed.

Referring generally to FIGS. 1-16, the present disclosure further includes a method of utilizing a spherical puzzle 10 for providing user enjoyment. Such a method includes the initial step of: providing a portable body 12 including a central core 13, a plurality of co-extensively shaped sections 11 rotatably disposed about the central core 13, a plurality of locking mechanisms 14 associated with the sections 11, respectively, and a plurality of hemispherical travel paths 15 configured about the body 12. Advantageously, the method further includes the steps of: dynamically configuring the sections 11 to freely rotate along the hemispherical travel paths 15 and create a desired pattern; and the locking mechanisms 14 slidably engaging the sections 11 such that the sections 11 remain rotatably aligned along the hemispherical travel paths 15 and about the central core 13. Such method steps yield the new, useful, and unexpected results of ensuring the sections 11 smoothly rotate each wedge-shaped section 11 along 180 degrees and any of the six planes of the sphere 10 while selectively engaging the locking mechanisms 14 as needed.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A spherical puzzle for providing user enjoyment, said spherical puzzle comprising: a body including a central core;

a plurality of sections rotatably disposed about said central core;

a plurality of locking mechanisms associated with said sections, respectively; and a plurality of hemispherical travel paths configured about said body;

wherein said sections are dynamically configured to freely rotate along said hemispherical travel paths to create a desired pattern;

wherein said locking mechanisms slidably engage said sections such that said sections remain rotatably aligned along said hemispherical travel paths and about said central core;

wherein each of said sections includes a plurality of slotted tracks arranged in a stacked configuration, a guide rail juxtaposed adjacent to said slotted tracks, an outer surface exposed to an ambient atmosphere, a cut-out area located adjacent to said outer surface, and an inner surface hidden from the ambient atmosphere and having a guide member statically affixed thereto, said guide member being rotated about said central core;

wherein associated ones of said slotted tracks and said guide rails are slidably interfitted along alternate ones of said sections.

2. The spherical body of claim 1, wherein said body has an outer surface of a ball.

3. The spherical body of claim 1, wherein said central core has a sphere shape.

4. The spherical body of claim 1, wherein said body has a spherical shape.

5. The spherical body of claim 1, wherein said slotted tracks have arcuate shapes, wherein said guide rail has an arcuate shape.

6. The spherical body of claim 1, wherein said locking mechanism comprises: a spring-actuated snap lock including a resiliently compressible frame;

a ball joint attached to said resilient frame; and a pair of stops located adjacent to said outer surface;

a disc mated to said ball joint;

wherein said spring-actuated snap lock slidably engages and disengages said stops as said section is rotated along said hemispherical travel paths and thereby maintains said section aligned about said central core.

7. A spherical puzzle for providing user enjoyment, said spherical puzzle comprising: a portable body including a central core;

a plurality of sections rotatably disposed about said central core;

a plurality of locking mechanisms associated with said sections, respectively; and a plurality of hemispherical travel paths configured about said body;

wherein said sections are dynamically configured to freely rotate along said hemispherical travel paths to create a desired pattern;

wherein said locking mechanisms slidably engage said sections such that said sections remain rotatably aligned along said hemispherical travel paths and about said central core;

wherein each of said sections are co-extensively shaped;

wherein each of said sections includes a plurality of slotted tracks arranged in a stacked configuration, a guide rail juxtaposed adjacent to said slotted tracks, an outer surface exposed to an ambient atmosphere, a cut-out area located adjacent to said outer surface, and an inner surface hidden from the ambient atmosphere and having a guide member statically affixed thereto, said guide member being rotated about said central core;

wherein associated ones of said slotted tracks and said guide rails are slidably interfitted along alternate ones of said sections.

8. The spherical body of claim 7, wherein said body has an outer surface of a ball.

9. The spherical body of claim 7, wherein said central core has a sphere shape.

10. The spherical body of claim 7, wherein said body has a spherical shape.

11. The spherical body of claim 7, wherein said slotted tracks have arcuate shapes, wherein said guide rail has an arcuate shape.

12. The spherical body of claim 7, wherein said locking mechanism comprises: a spring-actuated snap lock including a resiliently compressible frame;

a ball joint attached to said resilient frame; and a pair of stops located adjacent to said outer surface;

a disc mated to said ball joint;

wherein said spring-actuated snap lock slidably engages and disengages said stops as said section is rotated along said hemispherical travel paths and thereby maintains said section aligned about said central core.

13. A method of utilizing a spherical puzzle for providing user enjoyment, said method comprising the steps of:

providing a portable body including a central core, a plurality of sections rotatably disposed about said central core, a plurality of locking mechanisms associated with said sections, respectively, and a plurality of hemispherical travel paths configured about said body, wherein each of said sections are co-extensively shaped;

dynamically configuring said sections to freely rotate along said hemispherical travel paths and create a desired pattern; and said locking mechanisms slidably engaging said sections such that said sections remain rotatably aligned along said hemispherical travel paths and about said central core;

wherein each of said sections includes a plurality of slotted tracks arranged in a stacked configuration, a guide rail juxtaposed adjacent to said slotted tracks, an outer surface exposed to an ambient atmosphere, a cut-out area located adjacent to said outer surface, and an inner surface hidden from the ambient atmosphere and having a guide member statically affixed thereto, said guide member being rotated about said central core;

wherein associated ones of said slotted tracks and said guide rails are slidably interfitted along alternate ones of said sections.

14. The method of claim 13, wherein said body has an outer surface of a ball.

15. The method of claim 13, wherein said central core has a sphere shape.

16. The method of claim 13, wherein said body has a spherical shape.

17. The method of claim 13, wherein said slotted tracks have arcuate shapes, wherein said guide rail has an arcuate shape; wherein said locking mechanism comprises: a spring-actuated snap lock including a resiliently compressible frame;

a ball joint attached to said resilient frame; and a pair of stops located adjacent to said outer surface;

a disc mated to said ball joint;

wherein said spring-actuated snap lock slidably engages and disengages said stops as said section is rotated along said hemispherical travel paths and thereby maintains said section aligned about said central core.

* * * * *